US007185842B2

(12) United States Patent
Lewis et al.

(10) Patent No.: US 7,185,842 B2
(45) Date of Patent: Mar. 6, 2007

(54) DISPENSER FOR ROLLED SHEET MATERIAL

(75) Inventors: Richard Paul Lewis, Marietta, GA (US); Paul Francis Tramontina, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 345 days.

(21) Appl. No.: 10/881,494

(22) Filed: Jun. 30, 2004

(65) Prior Publication Data

US 2006/0011772 A1 Jan. 19, 2006

(51) Int. Cl.
*B65H 23/00* (2006.01)

(52) U.S. Cl. ..... 242/566; 242/419; 242/400

(58) Field of Classification Search ..... 242/419.4, 242/419.5, 566, 590
See application file for complete search history.

(56) References Cited

U.S. PATENT DOCUMENTS

| | | | |
|---|---|---|---|
| 462,479 | A | 11/1891 | Evans |
| 1,025,312 | A | 5/1912 | Rydquist |
| 1,026,128 | A | 5/1912 | Rydquist |
| 1,122,673 | A | 12/1914 | Winter et al. |
| 1,122,674 | A | 12/1914 | Winter et al. |
| 1,322,180 | A | 11/1919 | Crowell |
| 2,000,454 | A | 5/1935 | Peters |
| 2,138,154 | A | 11/1938 | Grunwald |
| 2,206,320 | A | 7/1940 | Grunwald |
| 2,298,179 | A | 10/1942 | Steiner et al. |
| 2,555,885 | A | 6/1951 | Hope |
| 2,592,786 | A | 4/1952 | Birr |
| 2,834,646 | A | 5/1958 | Berg |
| 2,974,850 | A | 3/1961 | Mayer |
| 3,098,594 | A | 7/1963 | Williamson |
| 3,127,121 | A | 3/1964 | Babin |
| 3,156,392 | A | 11/1964 | Johannes |
| 3,301,617 | A | 1/1967 | Goodwin et al. |
| 3,428,267 | A | 2/1969 | Briles |
| 3,770,172 | A | 11/1973 | Nystrand et al. |
| 4,079,874 | A | 3/1978 | Cox et al. |
| 4,119,255 | A | 10/1978 | D'Angelo |
| 4,179,078 | A | 12/1979 | Mansfield |
| 4,274,573 | A | 6/1981 | Finkelstein |
| 4,306,687 | A | 12/1981 | Hadtke |
| 4,690,344 | A | 9/1987 | Yokota |
| 4,756,460 | A | 7/1988 | Ornros |
| 4,775,109 | A | 10/1988 | Tegg |
| 4,804,149 | A | 2/1989 | Murphy |
| 5,048,589 | A | 9/1991 | Cook et al. |
| 5,201,595 | A * | 4/1993 | Oda ..... 400/618 |

(Continued)

FOREIGN PATENT DOCUMENTS

| | | | |
|---|---|---|---|
| DE | 19922198 | A1 | 11/2000 |
| JP | 57-180574 | * | 11/1982 |

*Primary Examiner*—John Q. Nguyen
(74) *Attorney, Agent, or Firm*—Richard M. Shane; Nathan P. Hendon

(57) ABSTRACT

The present invention provides an apparatus for dispensing rolled sheet material, the apparatus including a housing that defines an interior adapted to rotatably support rolled sheet material and having a dispensing opening sized to allow sheet material to be dispensed therefrom. The apparatus further includes a floating nip within the housing such as, for example, may be formed by first and second rollers. The floating nip minimizes variation in the force required to remove sheet material from the dispenser that may result from a user changing the angle at which sheet material is removed.

13 Claims, 3 Drawing Sheets

U.S. PATENT DOCUMENTS

| | | | |
|---|---|---|---|
| 5,294,617 | A | 3/1994 | Venkatesan et al. |
| 5,399,412 | A | 3/1995 | Sudall et al. |
| 5,674,590 | A | 10/1997 | Anderson et al. |
| 5,743,397 | A | 4/1998 | Traver |
| 5,772,845 | A | 6/1998 | Farrington, Jr. et al. |
| 5,875,985 | A | 3/1999 | Cohen et al. |
| 5,904,316 | A | 5/1999 | Dunning et al. |
| 5,904,971 | A | 5/1999 | Anderson et al. |
| 6,070,821 | A | 6/2000 | Mitchell |
| 6,196,493 | B1 | 3/2001 | Tanaka |
| 6,248,212 | B1 | 6/2001 | Anderson et al. |
| 6,273,996 | B1 | 8/2001 | Hollenberg et al. |
| 6,405,972 | B1 | 6/2002 | Wakam |
| 6,412,655 | B1 | 7/2002 | Stuetzel et al. |

* cited by examiner

DISPENSER FOR ROLLED SHEET MATERIAL

BACKGROUND OF THE INVENTION

No-touch dispensers, i.e., dispensers that do not require the patron to touch any part of the dispenser, are desired for many reasons. No-touch dispensing reduces the chance of transferring disease-causing bacteria, viruses and other microorganisms. No-touch dispensing also makes the process of obtaining a sheet simpler and quicker.

Single-sheet dispensers, i.e., dispensers that dispense a consistent, fixed quantity of sheet material, are also desired for many reasons. They tend to reduce the quantity of sheet material used by an individual patron, thereby saving on material costs, disposal costs, and costs associated with the frequency whereby the dispensers must be refilled.

No-touch, single-sheet dispensers for folded, interleaved sheets are known, however the manufacturing processes associated with providing the folded, interleaved sheets are more expensive and complex than the process associated with providing roll products. No-touch, single-sheet dispensers utilizing knives or other cutting devices to cut sheet material from a roll of sheet material are known, but knives and other cutting devices may present a danger to either a patron or an individual refilling the dispenser. No-touch, single-sheet dispensers for rolled products via zones of weakness are known, but if the sheet material tears before the next zone of weakness emerges from the dispenser, the next patron has no sheet material to grasp.

No-touch, single-sheet dispensing of double rolled products via offset zones of weakness is known, but dispensers for these products still have disadvantages that have yet to be overcome. As an example, many of the prior art dispensers have the disadvantage that the force necessary to dispense the product can vary depending on the angle at which a user of the product pulls on the exposed product. If the applied force is too low, the zones of weakness may not separate, causing more than one sheet to be removed from the dispenser. If the applied force is too high, the zones of weakness may separate prematurely or the product may break at a location other than at the next successive zone of weakness. The features of the dispenser disclosed herein overcome these and other disadvantages of prior art dispensers.

SUMMARY OF THE INVENTION

The aforesaid needs are fulfilled and the problems experienced by those skilled in the art overcome by the apparatus for dispensing rolled sheet material of the present invention. In one embodiment, the apparatus includes a housing defining an interior adapted to rotatably support rolled sheet material, the housing further defining a dispensing opening sized to allow sheet material to be dispensed therefrom. The apparatus further includes a floating nip within the housing, the floating nip positioned to restrain sheet material dispensed from the dispensing opening.

In one aspect of the invention, the floating nip includes a first nipping member that includes a curved surface and a second nipping member that includes a substantially planar surface. Desirably, the first nipping member is biased towards the second nipping member and the second nipping member is biased towards the first nipping member in such a way that the curved surface impinges the substantially flat surface to nip sheet material being dispensed. Desirably, the curved surface has a radius of curvature smaller than about 5 millimeters. More desirably, the curved surface has a radius of curvature smaller than about 2 millimeters.

The first nipping member may further include first and second arms. The first and second arms are desirably rotatable about first and second torsion springs. The first and second torsion springs bias the curved surface of the first nipping member towards the substantially flat surface of the second nipping member. The first nipping member is desirably rotatable within the housing about the third and fourth torsion springs through an angle greater than about 15 degrees, even more desirably through an angle greater than about 30 degrees.

The second nipping member is desirably rotatable about third and fourth torsion springs. The third and fourth torsion springs bias the substantially flat surface of the second nipping member towards the curved surface of the first nipping member.

Desirably, the torsion springs are sized to provide a pressure and/or level of friction in the nip low enough to allow sheet material to be withdrawn from the housing without breaking the sheet material and high enough to allow lines of weakness in the sheet material to break after the lines of weakness emerge from the nip during dispensing. Additionally, the position of the floating nip desirably self-adjusts to accommodate a change in the angle at which sheet material is withdrawn from the dispensing opening. Self-adjustment of the floating nip reduces variation in the nip pressure and/or withdrawal friction, thereby reducing the variation in the magnitude of the force necessary to remove sheet material from the dispenser.

In another aspect of the invention, the floating nip may include at least one roller. Desirably the nip is pressurized. Even more desirably, the nip is pressurized by at least one spring.

In another embodiment, the apparatus for dispensing rolled sheet material includes a housing defining an interior adapted to rotatably support rolled sheet material and having a dispensing opening sized to allow sheet material to be dispensed therefrom, a roll of sheet material having a plurality of zones of weakness that substantially extend across the width of the sheet material, and a pivotable nip within the housing. The nip includes a first nip member and a second nip member, the first nip member being resiliently biased against the second nip member, and the second nip member being resiliently biased against the first nip member. The sheet material is dispensed along a path that extends from the roll of sheet material, through the pivotable nip, and through the dispensing opening. Desirably, the rolled sheet material comprises inner and outer layers of sheet material, the layers of sheet material comprising a plurality of offset zones of weakness that substantially extend across the width of the sheet material.

In one aspect, the pivotable nip is movable to accommodate changes in the angle at which the sheet material is withdrawn from the dispensing opening. The nip pivots so that the orientation of the sheet material within the nip does not substantially change despite changes in the angle at which a user withdraws sheet material from the dispenser.

Other features and aspects of the present invention are discussed in greater detail below.

BRIEF DESCRIPTIONS OF THE DRAWINGS

DETAILED DESCRIPTION

Figure 2:
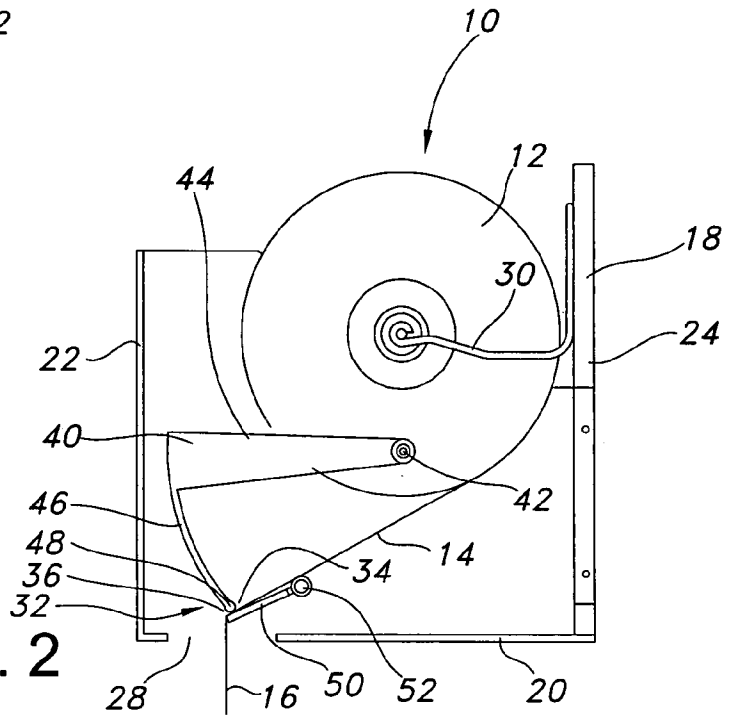
FIG. 2 is a partial cross-sectional diagrammatic view of the dispenser of FIG. 1.

Reference will now be made in detail to the various embodiments of the invention, one or more examples of which are illustrated in the drawings. Each embodiment is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

The present invention provides an apparatus for dispensing rolled sheet material. Exemplary sheet materials for which the present invention is suitable include, but are not limited to, absorbent sheet materials such as towels, wipers, tissue, and so forth. Suitable sheet materials are disclosed, by way of non-limiting examples only, in U.S. Pat. No. 5,048,589 to Cook et al., U.S. Pat. No. 5,399,412 to Sudall et al., U.S. Pat. No. 5,674,590 to Anderson et al., U.S. Pat. No. 5,772,845 to Farrington, Jr. et al., U.S. Pat. No. 5,904,971 to Anderson et al., U.S. Pat. No. 6,248,212 to Anderson et al., and U.S. Pat. No. 6,273,996 to Hollenberg et al., the entire contents of which are incorporated herein by reference. The sheet materials for which the present invention is suitable are desirably wound around a core, yet may, for other embodiments, be coreless. The sheet materials for which the present invention is suitable desirably have regularly spaced zones of weakness extending substantially across the width of the sheet material. The zones of weakness are used to separate the sheet material into individual sheets and may be, for example, defined by a series of perforations. The sheet material having regularly spaced zones of weakness substantially extending across its width is desirably double wound into a roll having inner and outer layers of sheet material wherein the zones of weakness for the inner and outer layers are offset as is taught in U.S. Pat. No. 3,770,172 to Nystrand, incorporated herein by reference in its entirety. The use of double-wound sheet material having offset zones of weakness allows the sheet material to tear within the dispenser while still providing a tail of sheet material extending from the dispenser to be grasped by the next patron.

Figure 5:
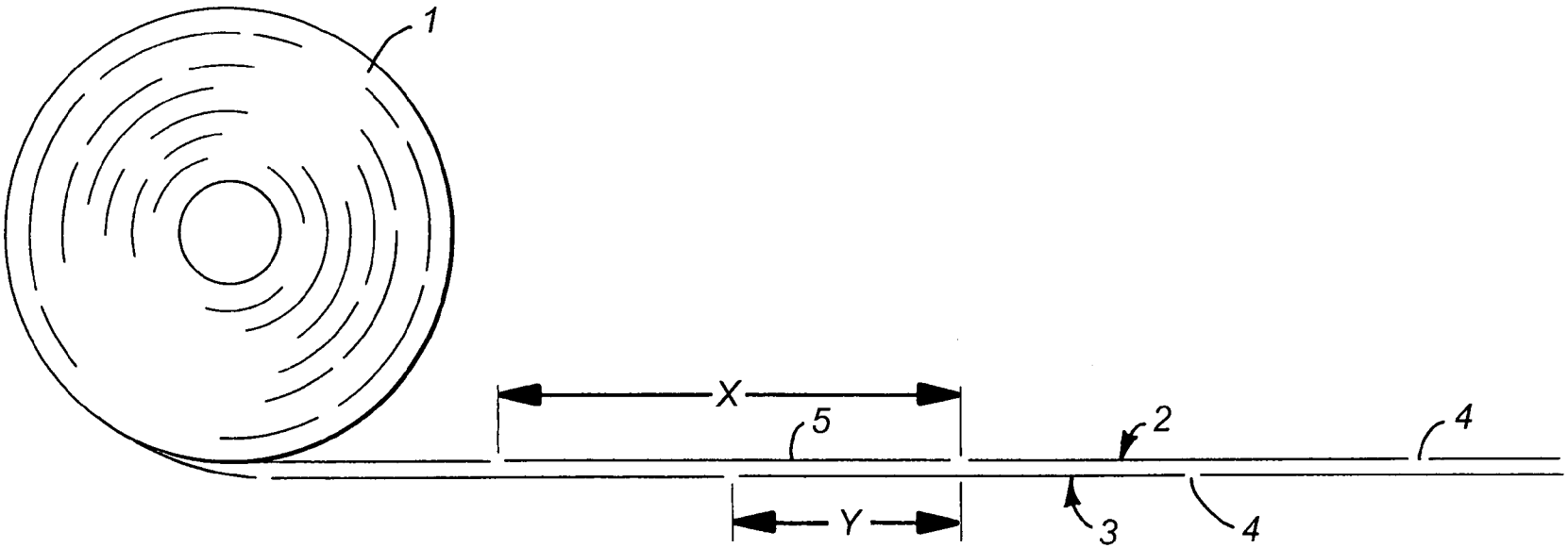
FIG. 5 shows a plan view of a roll of sheet material.

FIG. 5 shows a roll of sheet material 1 that has been unwound slightly from its outer surface to show the offset perforation arrangement. The roll 1 comprises an inner web 2 and an outer web 3 each having perforations 4 which allow individual sheets 5 to be detached from the webs. The individual sheets have a length X. The offset of the perforations is shown as length Y, and in this embodiment has an offset of about 50/50.

It is envisioned that any suitable amount of offset may be used for the webs. The offset can be expressed in terms of a ratio of percentages; the ratio must total 100, the sum of both lengths totaling the whole length of one sheet. Desirably, the offset ratio is less than about 70/30, and more desirably the ratio is less than about 60/40. Even more desirably, the offset is about 50/50, with each sheet being presented in an amount equal to that of the previous and the subsequent sheets. However, any offset in the range between about 50/50 and about 70/30 has been found to work adequately.

If there is an uneven offset present, it is desirable that the outer web projects more once a sheet has been detached from the inner web than the inner web projects when a sheet has been detached from the outer web. When the outer web is pulled from the roll and out of the dispenser, it will almost certainly pull the inner one with it because of the way the webs are wound up. Conversely, when the inner web is pulled, the certainty that the outer web will be pulled out is less because the inner web does not surround the outer web; more reliance is placed on the friction or other attachment between the two webs to pull the outer web from the dispenser. Therefore, it is desirable that the outer web projects by a greater amount than the inner web each time so that there is more chance that the outer web will be drawn through the dispenser with the inner web.

Embodiments of a dispenser 10 incorporating basic operational features according to the present invention are illustrated in FIGS. 1–4. The dispenser 10 is configured to dispense a primary roll 12 of web material 14 that may be, for example, a standard eight-inch towel roll. For illustrative purposes only, the roll 12 will be referred to as a towel roll and the web material will be referred to as towel material.

Figure 1:
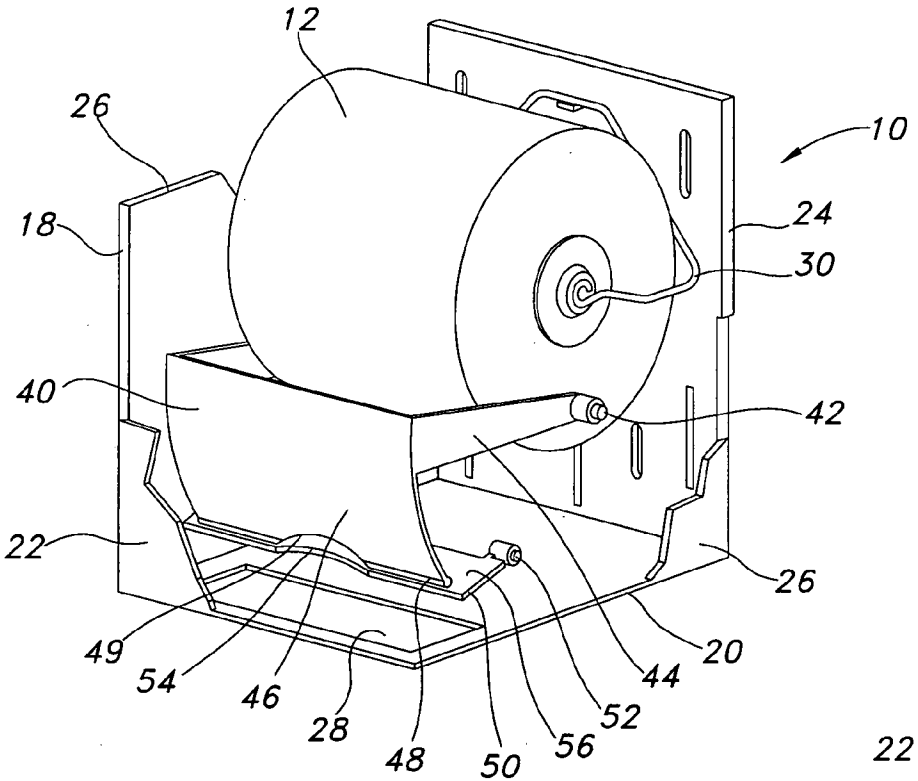
FIG. 1 is a perspective view depicting the interior of a dispenser of the present invention.

Referring to FIG. 1, the dispenser 10 includes a housing 18 of any general shape and configuration. The housing 18 includes a bottom portion 20, a front portion 22, a back portion 24, and side portions 26. The dispenser 10 may be mounted to a vertical supporting wall structure by any conventional means. A dispensing slot 28 is defined at an appropriate location in the housing 18. In the illustrated embodiment, the dispensing slot 28 is provided in the bottom portion 20. It should be understood that the dispensing slot 28 may be disposed at various locations in the housing depending on the conveying path of the towel material 14 and configuration of the internal components of the dispenser 10. The dispensing slot 28 is desirably disposed so that a user can see a tail 16 of the towel material extending therefrom and has easy access to grasp and pull the tail.

It should be appreciated that the dispenser 10 according to the invention is not limited in its construction by any particular type of materials. For example, the back portion 24 and/or bottom portion 20 may be formed as a sheet metal assembly and the front portion 22 may comprise a removable or pivotal plastic assembly.

The roll 12 is rotatably disposed in the housing 18 by any manner of suitable carrier, such as side arms 30. Various configurations of carrier mechanisms are known in the art for rotatably supporting a roll of material in a dispenser, and any such device may be used with the present invention.

Optionally, there may be a window defined in the housing to allow viewing of the interior of the dispenser. The window may be open, or may be constructed of a transparent or translucent material that permits viewing of the interior of the dispenser.

Figure 3:
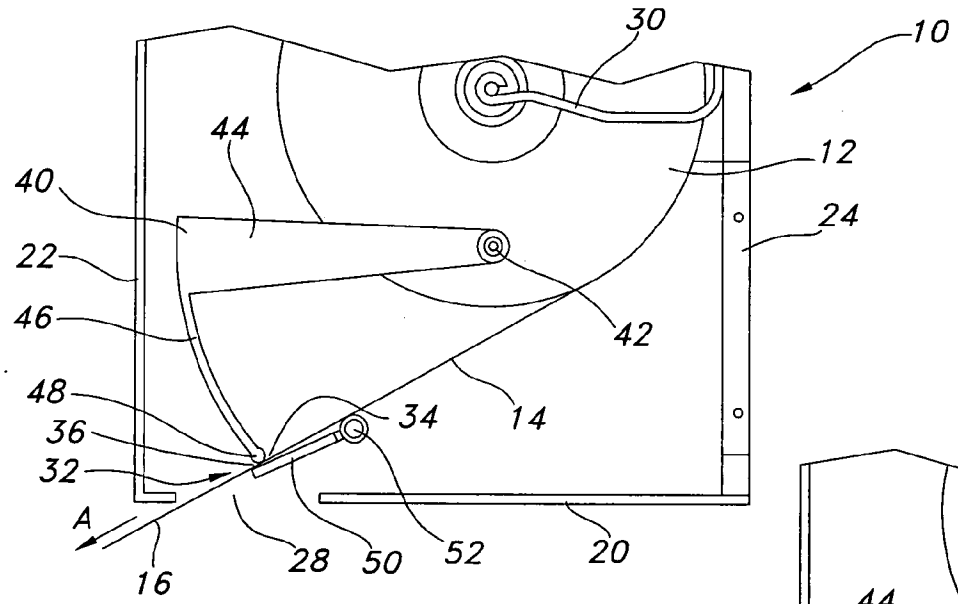
FIGS. 3 & 4 are operational cross-sectional diagrammatic views of the dispenser of FIG. 1.
Figure 4:
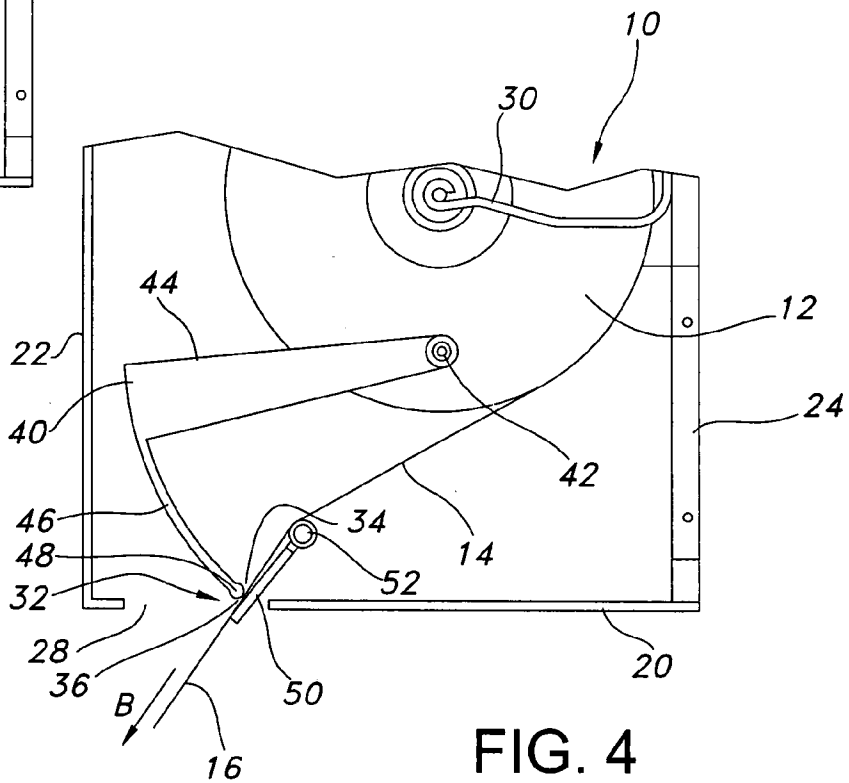

Referring to FIGS. 2–4, within the housing 18 is a floating nip 32. The floating nip 32 has an entrance side 34 and an exit side 36. As the towel material 14 is dispensed, the towel material enters the floating nip 32 on the entrance side 34 and exits on the exit side 36 before traveling through the dispensing slot 28. The nip 32 is formed between first and second nipping members 40, 50. Desirably, the floating nip 32 has a length approximately equal to the width of the towel material 14 being dispensed. However, the nip 32 may be interrupted by first and/or second recessed portions 49, 54 in the first and/or second nipping members 40, 50 respectively (see FIG. 1). The recessed portions 49, 54 allow a user to grasp towel material 14 on the entrance side 34 of the floating nip 32 in the event there is no tail extending from the dispensing opening 28.

The nipping members 40, 50 are biased and/or pressurized against one another. As depicted in the figures, the first nipping member 40 rotates about and is biased by at least one first torsion spring 42. The second nipping member 50 rotates about and is biased by at least one second torsion spring 52. Desirably, first and second nipping members 40, 50 are each biased by two torsion springs to provide substantially equal force within the floating nip 32 from one end of the nip to the opposite end. Alternatively, other mechanisms known to those skilled in the art may be used for biasing or pressurizing the first nip member 40 and the second nip member 50 against one another.

The magnitude of the force exerted by the first nip member 40 against the second nip member 50 is desirably such that the tension required to pull the towel material 14 through the floating nip 32 exceeds the breaking strength of zones of weakness in the towel material. However, the tension required to pull the towel material 14 through the floating nip 32 desirably does not exceed the breaking strength of the towel material 14 in areas other than the zone of weakness. Therefore, tension applied to the tail 16 of the towel material 14 extending from the dispensing opening 28 will advance the towel material 14 until a zone of weakness emerges from the floating nip 32. When the zone of weakness emerges from the floating nip 32, the zone of weakness will break, providing a single sheet to the patron, and leaving an extended tail of towel material 16 for the next patron to grasp. A detailed description of the desired force balance for dispensing double-wound rolls of offset-perforated sheet material can be found in U.S. Pat. No. 3,770,172 to Nystrand.

The magnitude of the force required to pull sheet material through a fixed nip can change depending on the angle at which a user pulls the tail from the dispensing opening. For example, if a user pulls on the tail in a more upwardly or downwardly direction, the sheet material may have a larger wrap angle around one of the nipping members. The larger wrap angle creates more friction and results in a greater force being necessary to pull the sheet material through the nip. The floating nip 32 of the present invention is self-adjusting with respect to the angle at which sheet material is withdrawn. Referring to FIG. 3, a more upwardly directed force applied to the tail material 16, depicted by arrow A, causes the first nipping member 40 to rotate upwardly about the first torsion springs 42. Because the second nip member 50 is biased upwardly towards the first nip member, the sheet material remains clasped within the nip and remains properly oriented while traveling through and beyond the nip. Conversely, referring to FIG. 4, a more downwardly directed force, depicted by arrow B, causes the second nipping member 50 to rotate downwardly about the second torsion springs 52. Because the first nipping member 40 is biased towards the second nipping member 50, the sheet material remains clasped within the nip 32 and is removed from the nip at the desired angle. Because the towel material 14 is removed at the desired angle with respect to the floating nip 32, the tension required to dispense the towel material remains consistent and results in more consistent dispensing performance.

Referring again to FIG. 1, the second nipping member 50 includes a nipping surface 56. The nipping surface 56 nips the towel material 14 against the first nipping member 40 during dispensing of sheet material. Desirably the nipping surface 56 is substantially flat and/or planar to provide a relatively large surface area for the first nipping member 40 to impinge against. Therefore, as the floating nip 32 moves to adjust for changes in the dispensing angle of the towel material 14, slight lateral movement of the first nipping member 40 with respect to the second nipping member 50 will not cause the first and second nipping members to disengage. Disengagement of the nipping members 40, 50 is to be avoided, as disengagement will degrade dispensing performance.

The first nipping member 40 desirably includes a rounded end 48 that impinges against the nipping surface 56 of the second nipping member 50. The rounded end 48 provides a curved surface that minimizes the surface area of the first nipping member 40 that contacts the towel material 14 passing through the floating nip 32. Desirably, the curved surface has a radius of curvature smaller than about 5 millimeters. More desirably, the curved surface has a radius of curvature smaller than about 2 millimeters. Desirably, the rounded end 48 does not provide a sharp edge upon which sheet material could catch or tear. Therefore, the curved surface desirably has a radius of curvature greater than about 0.1 millimeters.

The rounded end 48 is desirably disposed on an extension member 46 that is disposed on arms 44. The arms 44 are biased as described above by the torsion springs 42. The extension member 46 is disposed approximately perpendicular to the arms 44. Such positioning minimizes the potential for deflection of the extension member 46 caused by the biasing against the second nipping member 50. The extension member 46 may be curved to allow the first nipping member 40 more rotational freedom about the torsion springs 42 without causing the extension member to contact the interior of the housing 18. During the dispensing operation, the first nipping member 40 is desirably rotatable within the housing about the torsion springs 42 through an angle greater than about 15 degrees, even more desirably through an angle greater than about 30 degrees. Greater rotational freedom of the nipping members 40, 50 permits the floating nip 32 to accommodate a greater range of dispensing angles.

The arms 44 extend towards the back portion 24 of the dispenser 10. Desirably, the arms are long enough such that rotation of the first nipping member 40 about the torsion springs 42 can be accomplished within the housing 18 without opening the housing. Therefore, in the event that the towel material 14 were to tear on the entry side 34 of the nip 32, the user may open the nip by raising the first nipping member 40 without opening the housing 18. The towel material 14 within the dispenser 10 may therefore be easily rethreaded through the floating nip 32.

The first and second nipping members as shown in the figures may be repositioned within the dispenser. For example, the nipping members 40, 50 may be positioned within the dispenser in a side-by side orientation. As another example, the first nipping member 40 may be positioned below the second nipping member 50. Therefore, the particular orientation of the nipping members within the dispenser is not critical to the performance, so long as the floating nip 32 is positioned in the path of the dispensing towel material 14 and is capable of self-adjustment to minimize the effect of changes in the angle at which a user dispenses the towel material.

While the invention has been described in detail with respect to specific embodiments thereof, it will be apparent to those skilled in the art that various alterations, modifications and other changes may be made without departing from the spirit and scope of the present invention. It is therefore intended that all such modifications, alterations and other changes be encompassed by the claims.

We claim:

1. An apparatus for dispensing rolled sheet material comprising:

a housing defining an interior adapted to rotatably support rolled sheet material, the housing further defining a dispensing opening sized to allow sheet material to be dispensed therefrom; and a floating nip within the housing, the floating nip positioned to restrain sheet material dispensed from the dispensing opening, wherein the floating nip comprises a first nipping member comprising a curved surface and a second nipping member comprising a substantially planar surface, wherein the curved surface impinges the substantially flat surface to nip sheet material being dispensed, wherein the first nipping member further comprises first and second arms, the first and second arms being rotatable about first and second torsion springs, the first and second torsion springs biasing the curved surface towards the substantially flat surface, wherein the second nipping member is rotatable about third and fourth torsion springs, the third and fourth torsion springs biasing the substantially flat surface towards the curved surface.

2. The apparatus of claim 1 wherein the position of the floating nip self-adjusts to accommodate a change in the angle at which sheet material is withdrawn from the dispensing opening.

3. The apparatus of claim 1 wherein the first nipping member is biased towards the second nipping member and the second nipping member is biased towards the first nipping member.

4. The apparatus of claim 1 wherein the curved surface has a radius of curvature smaller than 5 millimeters.

5. The apparatus of claim 1 wherein the curved surface has a radius of curvature smaller than 2 millimeters.

6. The apparatus of claim 1 wherein the first nipping member is rotatable about the first and second torsion springs within the housing through an angle greater than about 30 degrees.

7. The apparatus of claim 1 wherein the torsion springs are sized to provide a pressure in the nip low enough to allow sheet material to be withdrawn from the housing without breaking the sheet material and high enough to cause lines of weakness in the sheet material to break after the lines of weakness emerge from the nip during dispensing.

8. The apparatus of claim 1 wherein the first nipping member is rotatable about the first and second torsion springs within the housing through an angle greater than about 15 degrees.

9. An apparatus for dispensing rolled sheet material comprising:

a housing defining an interior adapted to rotatably support rolled sheet material and having a dispensing opening sized to allow sheet material to be dispensed therefrom;

a roll of sheet material having a plurality of zones of weakness that substantially extend across the width of the sheet material; and a pivotable nip within the housing, the nip comprising a first nip member and a second nip member, the first nip member being resiliently biased against the second nip member, and the second nip member being resiliently biased against the first nip member;

wherein the first nip member and the second nip member are pivotable in operation, and wherein said sheet material is dispensed along a path that extends from the roll of sheet material, through the pivotable nip, and through the dispensing opening.

10. The apparatus of claim 9 wherein the pivotable nip moves to accommodate changes in the angle at which the sheet material is withdrawn from the dispensing opening.

11. The apparatus of claim 9 wherein the rolled sheet material comprises inner and outer layers of sheet material, the layers of sheet material comprising a plurality of offset zones of weakness that extend substantially across the width of the sheet material.

12. The apparatus of claim 9 wherein the nip is pressurized.

13. The apparatus of claim 12 wherein the nip is pressurized by at least one spring.

* * * * *